US006068129A

United States Patent [19]

Chen

[11] Patent Number: 6,068,129

[45] Date of Patent: May 30, 2000

[54] INDICATING ADHESION STATUS BETWEEN SUBSTRATE AND ENCAPSULANT OF A PACKAGED ELECTRONIC DEVICE

[75] Inventor: Shih-Li Chen, Hsinchu, Taiwan

[73] Assignee: Caesar Technology Inc., Hsinchu, Taiwan

[21] Appl. No.: 09/184,262

[22] Filed: Nov. 2, 1998

[51] Int. Cl.[7] ..... B65D 85/00

[52] U.S. Cl. ..... 206/713; 206/459.1

[58] Field of Search ..... 206/701, 713, 206/722, 724, 305, 459.1, 813; 156/60, 64; 116/200

[56] References Cited

U.S. PATENT DOCUMENTS

| | | | |
|---|---|---|---|
| 5,287,962 | 2/1994 | Nomi et al. | 206/701 |
| 5,727,684 | 3/1998 | Webb et al. | 206/459.1 |
| 5,896,990 | 4/1999 | Barzana | 206/459.1 |

*Primary Examiner*—M. D. Patterson
*Assistant Examiner*—Luan K. Bui
*Attorney, Agent, or Firm*—Rosenberg, Klein & Lee

[57] ABSTRACT

An indicator based on the present invention for indicating the adhesion status between a substrate and the encapsulation layer of a packaged electronic device is characterized in that at least one indicating pattern and one indicating region surrounding the indicating pattern are formed on the substrate, the adhesion between the indicating pattern and the encapsulant is very good while that between the indicating region and the encapsulant is relatively poor, both the indicating pattern and the indicating region are covered by molding encapsulant which is stripped off when having become hardening, thereby the status of the indicating pattern appearing after stripping off the encapsulant can indicate the adhesion quality (integration quality) between the encapsulation layer and the substrate. The indicator realizes a non-destructive quality checking process in which each electronic device can be checked to achieve one hundred percent of quality control.

23 Claims, 4 Drawing Sheets

INDICATING ADHESION STATUS BETWEEN SUBSTRATE AND ENCAPSULANT OF A PACKAGED ELECTRONIC DEVICE

FIELD OF THE INVENTION

The present invention relates to the package of electronic devices, particularly to the substrate-based package of semiconductor devices, and specifically to quality control for substrate-based package of semiconductor devices.

BACKGROUND OF THE INVENTION

Usually compound is used to enclose electronic devices when packaging electronic devices, in order to prevent damage caused by external environment. A conventional configuration is shown in FIG. 1 where a substrate array 10 of a ball grid array (BGA) package is composed of many substrates 12 each having a supporting face for seating semiconductor devices thereon. The middle of the supporting face is installation region 14 for seating semiconductor devices.

It is usual to use two pieces of molds for forming an encapsulation based on simple and cheap compound molding. As shown in FIG. 1, a mold runner or gate 16 is set around comer 12. Plated with gold on substrate 12, the adhesion between it and encapsulation is low. The molding and the hardening thereafter are shown in FIG. 2 where encapsulation layer 18 covers semiconductor device and installation region 14 while mold runner or mold gate 16 has residual compound thereon, which was left by molding processing, and which forms extra encapsulant 20 to be stripped off later. Normally the adhesion between encapsulation layer 18 and installation region 14 is very good while that between mold runner or mold gate 16 and encapsulant 20 is relatively poor, thereby substrate 12 and the electronic devices below encapsulation layer 18 are not subjected to any damage when stripping off encapsulant 20.

One drawback with the above scheme is that the adhesion (integration quality) between encapsulation layer 18 and installation region 14 can't be easily known. The only way to test it is to check by stripping off encapsulation layer 18, resulting in a destructive checking which wastes checked products and is limited to sampling checking, thereby can't assure the good quality of those unchecked products. The present invention is therefore suggested to provide a solution to the problems inherent in conventional schemes of the field.

SUMMARY OF THE INVENTION

The primary object of the present invention is to provide an innovative indicator for indicating the adhesion status between substrate and encapsulation layer.

Another object of the present invention is to provide one type of substrate suitable for forming thereon an indicator for indicating the adhesion status between substrate and encapsulation layer.

The other object of the present invention is to provide a packaged electronic device capable of indicating the adhesion status between its encapsulation layer and substrate.

Another further object of the present invention is to provide one type of substrate having a mold runner or mold gate to further help achieving the indication of the adhesion status between encapsulation layer and substrate.

The other further object of the present invention is to provide one type of substrate capable of indicating the first pin of a packaged electronic device thereon.

A special object of the present invention is to provide a substrate to be used for packaging an electronic device and for displaying a trademark or any other specific marks after stripping off the encapsulant.

The indicator based on the present invention for indicating the adhesion status between a substrate and the encapsulation layer of a packaged electronic device may be characterized in that at least one indicating pattern and one indicating region surrounding the indicating pattern are formed on a substrate, the adhesion between the indicating pattern and the encapsulant is very good while that between the indicating region and the encapsulant is relatively poor, both the indicating pattern and the indicating region are covered by molding encapsulant which is stripped off when having become hardening, thereby the status of the indicating pattern appearing after stripping off the encapsulant can indicate the adhesion quality (integration quality) between the encapsulation layer and the substrate.

An alternative to embody the present invention is that the indicator performing the indication of the adhesion status is made to further function as a mold runner or mold gate which, when stripping off the extra encapsulant thereon after molding and the hardening of the encapsulant, can indicate the adhesion status between the encapsulation layer and the substrate Another alternative to embody the present invention is that the indicator performing the indication of the adhesion status is made to further function as a mark to indicate the first pin of the electronic device.

Not only can the indicator be used as a quality checking mark, but also can its indicating pattern be used a trademark or specific mark.

If the indicating pattern is configured to be composed of figures of different sizes, different adhesion status can be indicated. The indicating pattern may even be configured to enclose a test trace for achieving better quality checking (assurance).

The present invention may best be understood through the following description with reference to the accompanying drawings, in which:

DETAILED DESCRIPTION OF THE PREFERRED EMBODIMENTS

The present invention is related to the formation, on a package substrate, of an indicator for indicating the adhesion status between encapsulation layer and the substrate, which is composed of at least one indicating pattern and one indicating region surrounding the indicating pattern. The adhesion between the indicating pattern and the encapsulant is very good while that between the indicating region and the encapsulant is relatively poor. The indicating pattern and the indicating region are both covered by compound when molding, and the compound is stripped off after hardening. Because the adhesion between the indicating pattern and the encapsulant is significantly better than that between the indicating region and the encapsulant, the face on the top of the indicating pattern is removed when stripping off the encapsulant, thereby the part, such as copper, under its face is exposed, while the indicating region around the indicating pattern is smoothly stripped off without hurting the substrate thereunder.

Figure 1:
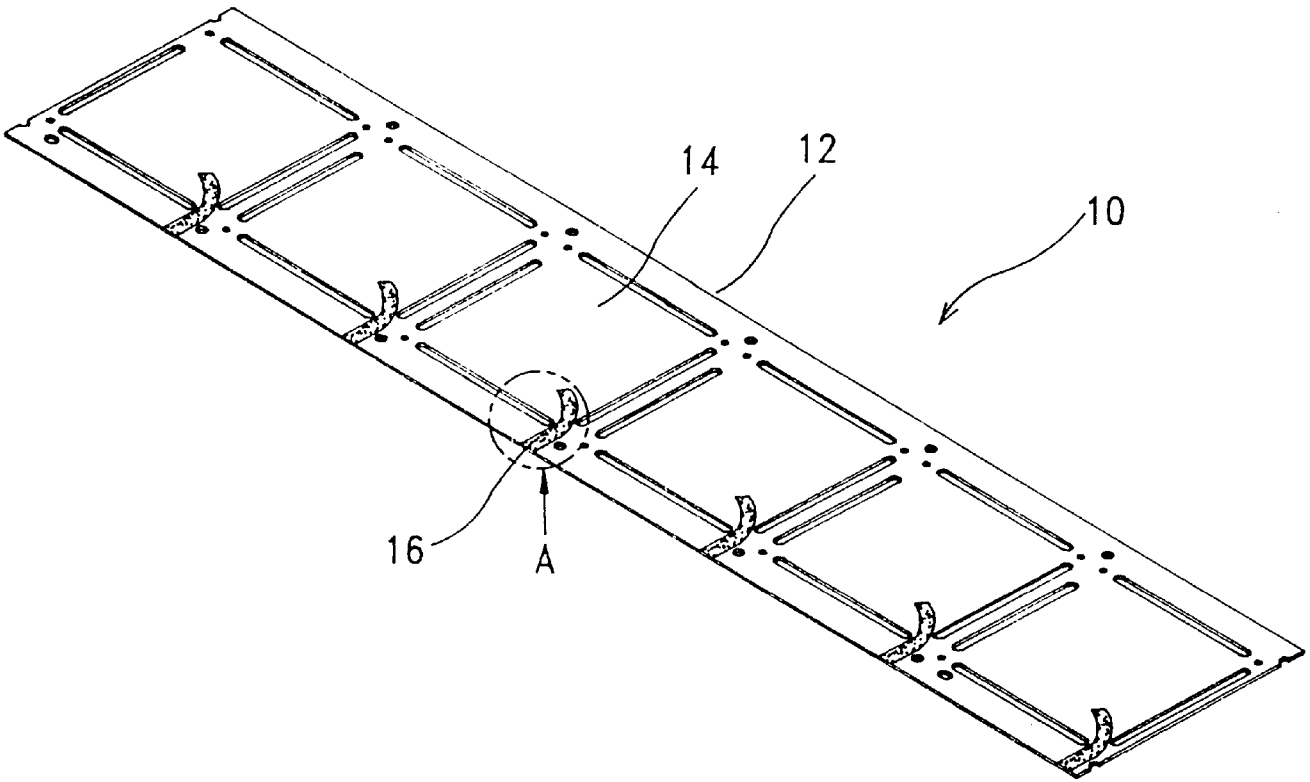
FIG. 1 (PRIOR ART)
FIG. 1 is a diagram showing a substrate array which is a strip composed of many substrates, and is used in a package of ball-grid-array configuration.
Figure 2:
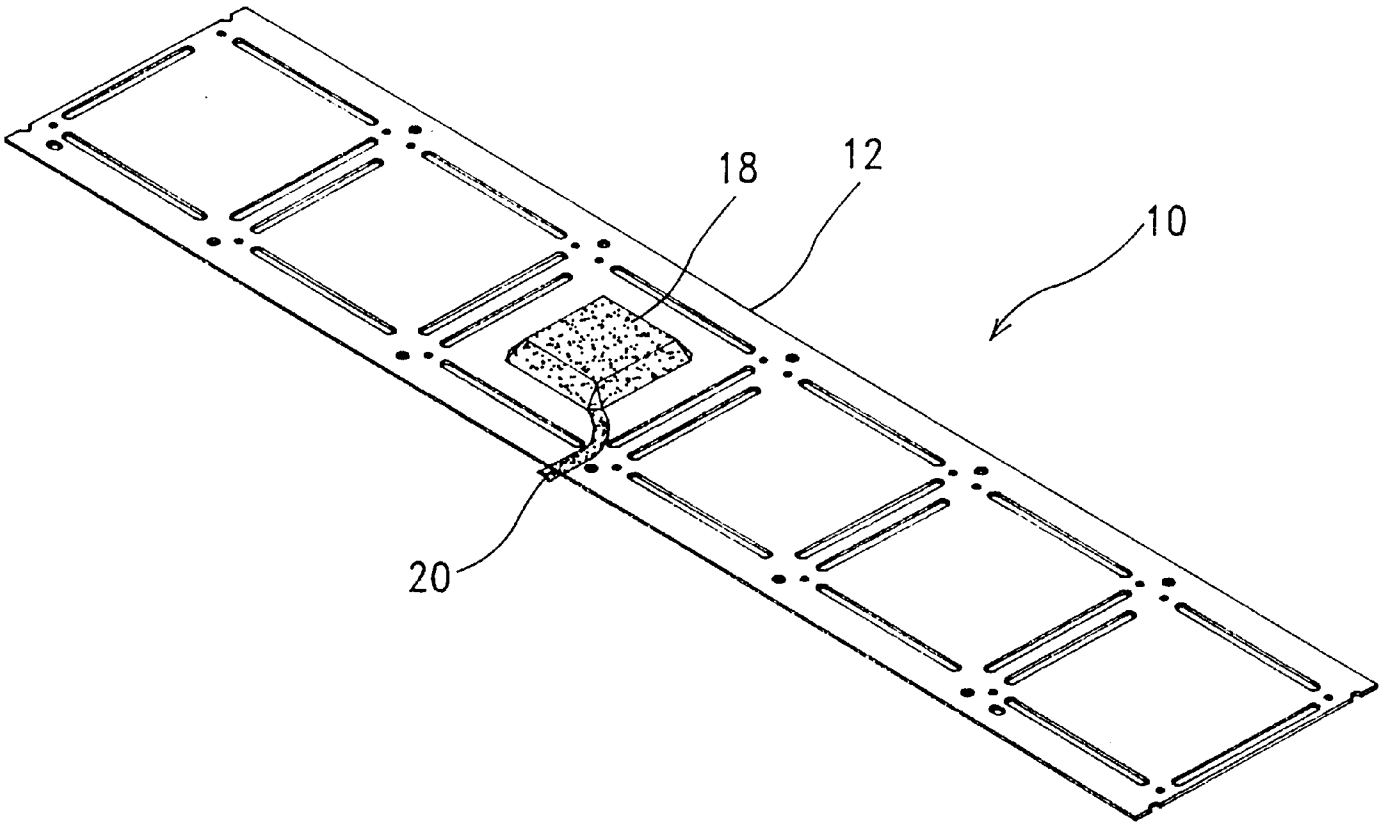
FIG. 2 (PRIOR ART)
FIG. 2 shows a package encapsulation layer formed by molding and hardening processing, with extra encapsulant not yet stripped.
Figure 3C:
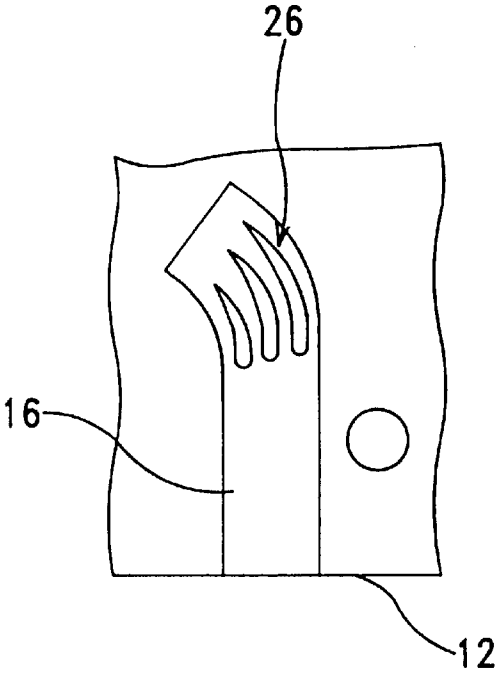
FIGS. 3*a*, 3*b*, and 3*c* respectively show three types of indicating patterns according to the present invention.
Figure 3B:
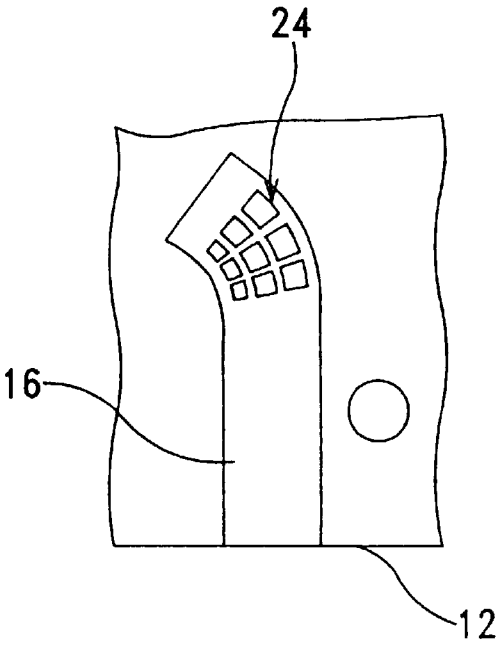
Figure 3A:
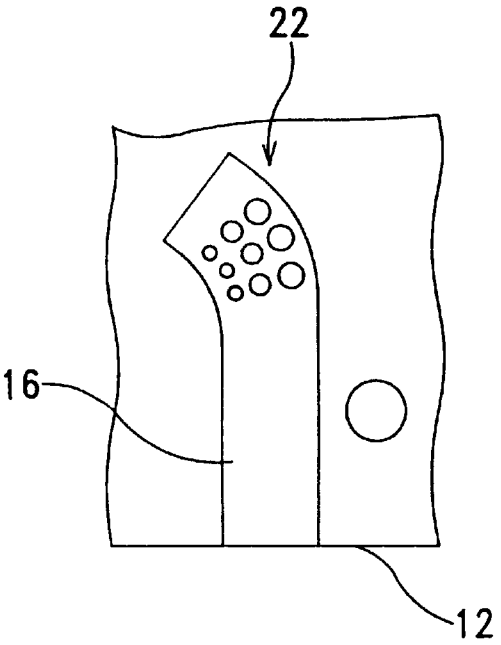

FIG. 3*a*, FIG. 3*b*, FIG. 3 respectively show three indicators with different indicating patterns 22, 24, 26, all are further used as mold runner or mold gate 16 such as the one shown in FIG. 1. In other words, these embodiments are configured to have mold runners or mold gates 16 associated with indicating patterns 22–26, and indicating regions surrounding these indicating patterns.

Although each of these embodiments is configured to have its indicator combined together with its mold runner or mold gate, it must be understood by those who skilled in the art that a configuration with mold runner or mold gate separated from indicator is also covered by the spirit of the present invention. Obviously such a configuration requires an indicator in addition to a mold runner or mold gate.

A preferred embodiment is that the position of the mold runner or mold gate 16 on the substrate 12 points to the first pin of the packaged electronic device, as a usual case conventionally. For those package substrates using three pieces of molds, which have no mold runner or mold gate, the indicator therein may be configured to point to the first pin of the packaged electronic device.

It is preferred that indicating patterns 22–26 have faces made of the same material (resin, for example) as the face of installation region 14, as can be done when manufacturing substrate 12. In other words, indicating patterns 22–26 are formed when spreading resin while the region surrounding the indicating patterns 22–26 is not covered by resin but plated (electrically) to form mold runner or mold gate 16 instead.

It is preferred that gold or palladium is used as the plating layer for mold runner or mold gate 16. Another material may also fit as long as its adhesion to package compound is relatively poor. Usually metal such as Cu, Al, etc shall fit.

Obviously the figure of indicating pattern is not limited. It can be any type of decorative picture, net design, character, or tradmark.

Please refer to FIG. 2 and FIG. 3*a*, FIG. 3*b*, FIG. 3*c*. When stripping off extra encapsulant 20, under the condition that the adhesion between indicating patterns 22–26 and encapsulant is as good as that between installation region 14 and encapsulation layer 18, the faces (made of material such as resin) of indicating patterns 22–26 are removed to expose the metal thereunder if the adhesion between encapsulation layer 18 and installation region 14 is very good. On the contrary, if the adhesion between encapsulation layer 18 and installation region 14 is not good enough, the faces of indicating patterns 22–26 can not be fully removed when stripping off extra encapsulant 20, thereby pretty metal color can not appear as expected.

Different color contrast may be achieved through forming the bottom layer of indicating pattern and indicating region by using different metal. Usually a substrate has copper as its internal metal base layer, hence the metal layer under the indicating pattern is copper. If another metal such as zinc was plated on the copper base layer before making mold runner or mold gate, indicating patterns 22–26 can show different colors after encapsulant 20 is stripped off.

It is preferred that indicating patterns 22–26 are in the shape of different sizes, thereby provide different sizes of areas for adhering to encapsulant, whereby the stripping status indicated by the indicating patterns of different sizes can represent different adhesion status between encapsulation layer and installation region. For example, that the smaller size of indicating pattern is fully stripped off to expose the metal thereunder while the bigger size of indicating pattern is not fully stripped off shall mean worse adhesion performance of the compound than that the bigger size of indicating pattern is fully stripped.

Figure 4B:
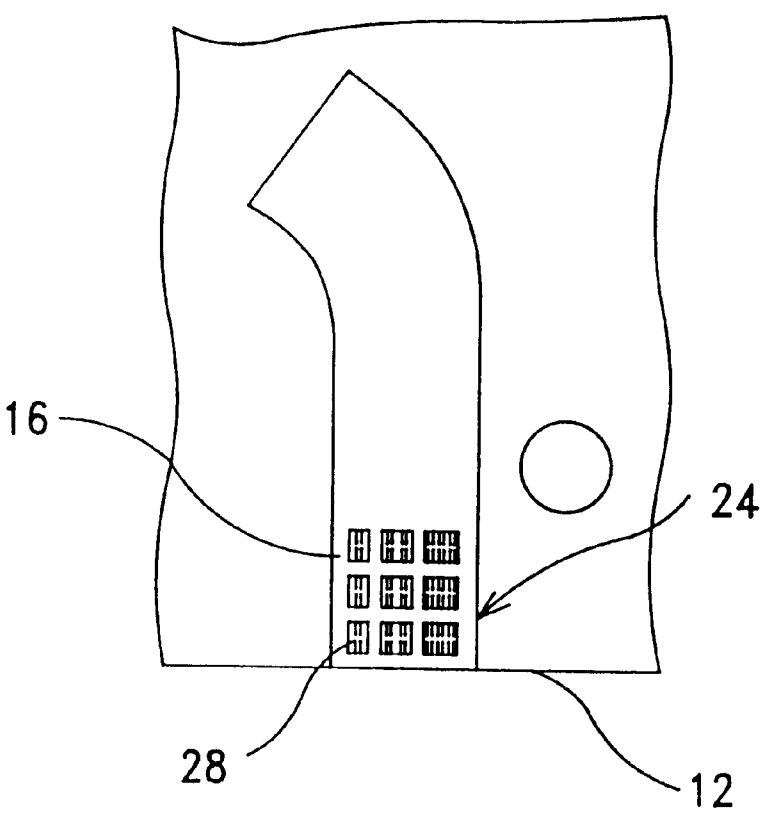
FIG. 4*a* and FIG. 4*b* respectively show an indicator capable of indicating different levels of adhesion between encapsulation layer and substrate.
Figure 4A:
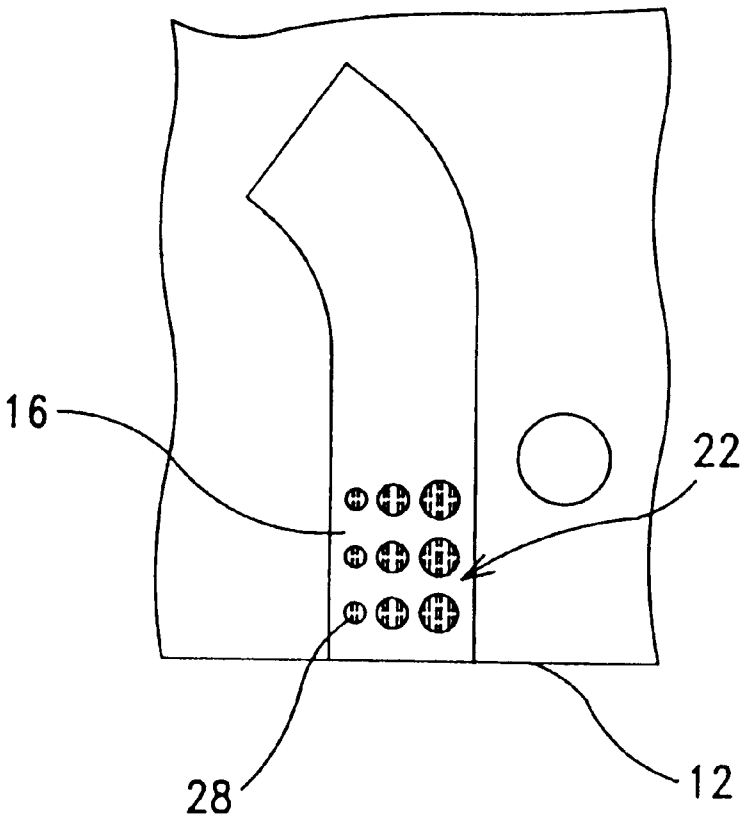

To meet the requirement of higher quality control standard, a scheme with different indicators as embodied by the two shown respectively in FIG. 4*a* and FIG. 4*b*, is suggested. In FIG. 4(*a*) and FIG. 4(*b*), under the faces (made of resin) of indicating patterns 22 and 24 are concealed test traces 28 which may be formed at the same time substrate 12 is made. The test trace 28 is not for practical application to conduct electronic signals, instead it is for indicating product quality based on that the removal of it as a result of stripping off the encapsulant above indicating patterns 22 and 24 means good quality of the product thus manufactured.

Based on the present invention, every substrate can have its own indicator for indicating the adhesion status between it and its encapsulation layer, thereby one hundred percent of quality checking can be realized. Furthermore, the scheme based on the present invention provides a non-destructive quality checking, causing no waste, requiring only visual checking which is simple, swift, cheap, and straightforward, and whereby allowing no chance for defective product to be shipped from factories.

It is clear the scheme suggested by the present invention for making an indicator for indicating the adhesion status between encapsulation layer and substrate can be implemented on the basis of conventional manufacturing process, without need of any extra facility or working process.

While the invention has been described in terms of what are presently considered to be the most practical and preferred embodiments, it shall be understood that the invention is not limited to the disclosed embodiment. On the contrary, it is intended to cover various modifications and similar arrangements included within the spirit and scope of the following claims which are to be accorded with the broadest interpretation to encompass all modifications and similar structures based thereon.

What is claimed is:

1. An indicator for indicating adhesion between an encapsulation layer and a substrate of a packaged electronic device having the encapsulation layer overlaying a face of the substrate, comprising:

an indicating region formed on a portion of the face of the substrate by a first material having a lower adhesion with the encapsulation layer than a desired adhesion between the face of the substrate and the encapsulation layer, said portion of the substrate being overlaid by a predetermined portion of the encapsulation layer adapted to be readily removed from a remaining portion of the encapsulation layer; and, at least one area formed on the face of said substrate, and having adhesion to the encapsulant of said packaged electronic device; and an indicating region surrounding said indicating pattern, and having relatively low adhesion to the encapsulant of said packaged electronic device of a second material and disposed in the indicating region, said second material matching that of a material of the face of the substrate, wherein removal of said second material from said area by removal of said predetermined portion of the encapsulation layer from said indicating region indicates the encapsulation layer has the desired adhesion with the face of the substrate.

2. The indicator according to claim 1 wherein said indicating region is a mold runner of said packaged electronic device.

3. The indicator according to claim 2 wherein said indicating region points to the first pin of said packaged electronic device.

4. The indicator according to claim 1 wherein said indicating region is made of metal.

5. The indicator according to claim 4 wherein said indicating region is made of metal selected from the group consisting of gold and palladium.

6. The indicator according to claim 1 further comprising a plurality of areas formed of said second material, at least a portion of said plurality of areas being of different sizes than other of said plurality of areas.

7. The indicator according to claim 1 further comprising at least one test trace disposed in said indicating region.

8. A substrate to be used as a supporter for packaging an electronic device, comprising:

a supporting face having a first region for installing the electronic device to be packaged thereon and a second region, said first region having adhesion of a first level to an encapsulant used in packaging the electronic device;

a material disposed in at least one area on said supporting face in said second region, and having adhesion of a second level to the encapsulant, the adhesion of said second level being approximately equal to that of said first level; and a layer of material formed in said second region surrounding said at least one area, said layer of material having adhesion of a third level to the encapsulant, said third level of adhesion being less than that of said second level, wherein removal of said material in said at least one area by removal of encapsulant overlaying said second region indicates a desired level of adhesion between said first region of said supporting face and an overlaying layer of encapsulant thereon.

9. The substrate according to claim 8 wherein said second region is a mold runner region.

10. The substrate according to claim 8 wherein said second region points to a pin of the electronic device having a designation as a first pin.

11. The substrate according to claim 8 wherein said layer of material in said second region is made of metal.

12. The substrate according to claim 8 wherein said layer of material in said second region is made of a metal selected from the group consisting of gold and palladium.

13. The substrate according to claim 8 further comprising a plurality of areas in said second region, at least a portion of said plurality of areas being of different sizes than other of said plurality of areas.

14. The substrate according to claim 8 further comprising at least one test trace disposed in said second region.

15. The substrate according to claim 8 wherein said second region adjoins said first region.

16. A packaged electronic device comprising:

a substrate having a supporting face, said supporting face including an installation region and indicating region, said installation region having an electronic device mounted thereon;

an encapsulation layer formed by an encapsulant material and covering said installation region, said indicating region, and said electronic device, a portion of said encapsulation layer covering said indicating region being adanted to be readily removed from a remaining portion of said encapsulation layer, said installation region having adhesion of a first level to said encapsulant material;

a material disposed in at least one area in said indicating region and shaped to define an indicia pattern, said material in said at least one area having adhesion of a second level to said encapsulant material, the adhesion of said second level being approximately equal to that of said first level; and a layer of material formed in said indicating region surrounding said indicia pattern, said layer of material having adhesion of a third level to said encapsulant material, said third level of adhesion being less than that of said second level, wherein removal of said material in said at least one area by removal of said portion of said encapsulation layer indicates a desired level of adhesion between said installation region of said supporting face and said encapsulation layer.

17. The packaged electronic device according to claim 16 wherein said indicating region is a mold gate.

18. The packaged electronic device according to claim 16 wherein said indicating region points to a pin of the electronic device having a designation as a first pin.

19. The packaged electronic device according to claim 16 wherein said layer of material in said indicating region is made of metal.

20. The packaged electronic device according to claim 16 wherein said layer of material in said indicating region is made of a metal selected from the group consisting of gold and palladium.

21. The packaged electronic device according to claim 16 further comprising a plurality of areas in said indicating region, said plurality of areas defining a plurality of indicia patterns of different sizes.

22. The packaged electronic device according to claim 16 further comprising at least one test trace disposed in said indicating region.

23. The packaged electronic device according to claim 16 wherein said indicating region adjoins said installation region.

* * * * *